US007587154B2

(12) United States Patent
Sakai et al.

(10) Patent No.: US 7,587,154 B2
(45) Date of Patent: Sep. 8, 2009

(54) DEVELOPING UNIT AND IMAGE FORMING APPARATUS USING THE SAME

(75) Inventors: Masahiro Sakai, Osaka (JP); Shuichi Akedo, Sakai (JP); Shigeki Hayashi, Ikoma-gun (JP); Teruyoshi Sudoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 11 days.

(21) Appl. No.: 11/956,382

(22) Filed: Dec. 14, 2007

(65) Prior Publication Data

US 2008/0170876 A1 Jul. 17, 2008

(30) Foreign Application Priority Data

Jan. 12, 2007 (JP) ..... 2007-003954

(51) Int. Cl.
*G03G 21/20* (2006.01)

(52) U.S. Cl. ..... 399/92; 399/93; 399/94; 399/98; 399/99

(58) Field of Classification Search ..... 399/92, 399/93, 94, 99
See application file for complete search history.

(56) References Cited

U.S. PATENT DOCUMENTS 5,283,615 A * 2/1994 Yokoyama et al. ..... 399/231
2005/0189100 A1* 9/2005 Kawahara et al. ..... 165/202

FOREIGN PATENT DOCUMENTS

| | | |
|---|---|---|
| JP | 10-3220 A | 1/1998 |
| JP | 10-274883 | 10/1998 |
| JP | 2000-267440 A | 9/2000 |
| JP | 2004-361869 | 12/2004 |
| JP | 2006-23413 | 12/2006 |

OTHER PUBLICATIONS

Machine Translation of JP 2006023413. Reference was cited by Applicants in IDS submitted Dec. 14, 2007.*

* cited by examiner

*Primary Examiner*—David M Gray
*Assistant Examiner*—Bryan P Ready
(74) *Attorney, Agent, or Firm*—Nixon & Vanderhye, PC

(57) ABSTRACT

A developing unit for developing an electrostatic latent image formed on the outer peripheral surface of a latent image bearing member rotating in one direction with a developer by mixing electrostatically chargeable toner and magnetic carrier, includes: a developing roller; a carrier collecting roller; a cooling portion including a forced draft duct for airflow from a fan and disposed on the bottom side of the developing vessel; a suctioning portion including a suctioning duct for airflow from suctioning ports disposed on the lower side of the carrier collecting roller, disposed under the forced draft duct; a filter for removing the scattering toner from air including the scattering toner suctioned from the suctioning ports; and, an exhaust portion including an airflow exhaust duct for discharging the air passed through the filter and the forced draft duct to an exhaust port.

20 Claims, 10 Drawing Sheets

FIG.8

| | |
|---|---|
| Machine under test | AR-705S(a product of Sharp Co., ) |
| Developer | For AR-705S (AR-705S modified machine) |
| Developing vessel | MGΦ30, carrier collecting roller, 7-poles MG |
| Duct and fan configurations | One toner suctioning fan (sirocco fan) + toner filter + ozone filter |
| | Two DB-type square axial-flow fans (24 V 0.09 A) + toner filter |
| DG (doctor gap) | 0.90 mm |
| Process speed | 540 mm/sec |
| Aging time | 3 hours |

FIG. 10

Table for comparison between the developing unit of the present invention and the conventional developing unit

| | Carrier reduction | Filter weight increase | Number of times of operation failures |
|---|---|---|---|
| Developing unit of the present invention | 1g | 3g | 0 |
| Conventional developing unit | 24g | 15g | 8 times |

DEVELOPING UNIT AND IMAGE FORMING APPARATUS USING THE SAME

This Nonprovisional application claims priority under 35 U.S.C. §119(a) on Patent Application No. 2007-3954 filed in Japan on 12 Jan. 2007, the entire contents of which are hereby incorporated by reference.

BACKGROUND OF THE TECHNOLOGY

1. Field of the Technology

The present technology relates to a developing unit used in an image forming apparatus such as a copier, printer, facsimile machine or the like using electrophotography as well as relating to an image forming apparatus including this developing unit. The technology in particular relates to a developing unit including a cooling mechanism of the developing vessel and a suctioning mechanism of scattering toner around the developing area using ducts.

2. Description of the Prior Art

With recent development of copiers, facsimile machines, printers and multi-functional machines having these functions into high-speed and high-resolution configurations, down-sizing of the carrier and toner used as the elemental technology for the electrophotographic process has been in progress. However, as the carrier and toner become smaller in size, in the developing area inside the image forming apparatus the carrier particles are prone to transfer to the image latent bearer, i.e., a photoreceptor drum during development, also toner is prone to scatter, causing image degradation and defects. Further, increase in processing speed brings about temperature increase in the developing unit, changes the developer characteristics and degrades the image quality, hence gives rise to the problem that the developer becomes solidified inside the developing unit and completely locks the developing unit itself, especially when the machine is used under a high temperature and high humidity environment.

In order to solve the above deficiencies, patent document 1 (Japanese Patent Application Laid-open Hei No. 10-274883) discloses a developing unit including: a developing vessel for holding a developer; a magnet roller disposed inside this developing vessel for supplying the developer to a photoreceptor drum; and a sanctioning fan with its suctioning ports arranged at both ends of the magnet roller so as to suction the developer scattering from the magnet roller through the suctioning ports. This developing unit enables efficient suctioning of scattering developer using a compact suctioning device and also enables reduction of the photoreceptor drum in diameter.

Another patent document 2 (Japanese Patent Application Laid-open 2006-23413) discloses an image forming apparatus which includes a developing unit having an integrally layered structure of a cooling duct and a scattering toner suctioning duct. That is, in this image forming apparatus, a cooling duct is provided in a space defined by the developing unit and a paper feed path for feeding recording paper to a transfer unit so as to cool the developing unit by sending cooling air into the duct while the cooling duct is formed with an opening that opposes the paper feed path so as to blow the cooling air to the recording paper that passes through the paper feed path. Further, a scattering toner suctioning duct for suctioning the toner scattering is formed under the cooling duct. With this image forming apparatus, it is possible to inhibit increase in the temperature inside the apparatus due to its heat-fixing process without hindering downsizing of the apparatus and reduction in the number of parts.

There is also another disclosure of an image forming apparatus in patent document 3 (Japanese Patent Application Laid-open 2004-361869), which includes a developer conveyer that has the developer electrostatically attracted to the electrostatic latent image formed on an image bearer; a housing that has a space for accommodating the developer conveyer and the developer and is formed with an opening parallel with the image bearer; a suctioning duct for suctioning floating toner and paper particulates in this housing; and a cooling duct for cooling the developing unit, wherein air is suctioned from the suctioning duct and cooling duct by a common suctioning means. In this image forming apparatus, it is possible to prevent increase in temperature while reducing toner scattering in the developing unit.

In the developing unit disclosed in patent document 1, a suctioning path for drawing scattering toner from below, and at both ends of, magnet (developing) roller and exhausting air through a filter located at the center is provided. However, there is no reference to a carrier collecting member. Further the suctioning means cannot suction the carrier and toner separately, so it is impossible to avoid carrier loss and filter clogging. Also, there is no mention of inclusion of any cooling means, so it is not clear whether cooling effect can be obtained or not.

In the image forming apparatus of patent document 2, the suctioning means and the cooling means are structured in two layers. However, there is no reference to a carrier collecting means, so it is impossible for the suctioning means to suction the carrier and toner separately from each other. Accordingly, reduction of the carrier in the developer and suctioning of toner together with the carrier cause the filter to be clogged up with the carrier. Further, since the cooling means is constructed to send air to the paper feed path but is not laid out to cool the entire bottom of the developing unit, it cannot be said that the cooling effect is sufficient.

Moreover, in the image forming apparatus of patent document 3, since the suctioning means and the cooling means are laid out in layers, but the cooling means is not constructed so as to cool the entire bottom of the developing unit, the cooling of the developing vessel is not effective enough. Also, there is no reference to a carrier collecting means, so it is impossible to suction the carrier and toner separately from each other. That is, this configuration has not reached to such a level as to solve the problems of carrier reduction, filter clogging and the like.

In sum, the developing units and image forming apparatuses disclosed in the above patent documents have yet to reach to such a level as to be able to prevent toner scattering as well as to realize effective enough cooling of the developing vessel and inhibit increase of the developing vessel in temperature. Also, since carrier and toner cannot be suctioned separately, any of the above configurations has not reached to so far as to solve the problems of carrier reduction and filter clogging.

SUMMARY OF THE TECHNOLOGY

The present technology has been devised in view of the above problems entailed with the conventional developing units, it is therefore an object of the present technology to provide a new and improved developing unit and image forming apparatus which can inhibit toner scattering and temperature increase of the developing vessel and which can suction toner and carrier separately from the developer.

In order to solve the above problem, a developing unit for developing an electrostatic latent image formed on the outer peripheral surface of a latent image bearing member rotating in one direction with an electrified developer that is prepared by mixing two components, or an electrostatically chargeable toner and magnetic carrier in a developing vessel, includes: a developing roller for conveying the developer to the latent image bearing member; a carrier collecting roller disposed on the downstream side of the developing roller with respect to the rotational direction of the latent image bearing member; a cooling portion including a forced draft duct for airflow from a fan and disposed on the bottom side of the developing vessel; a suctioning portion including a suctioning duct for airflow from suctioning ports disposed on the lower side of the carrier collecting roller for drawing scattering toner inside the developing unit, disposed under the forced draft duct; a filter for removing the scattering toner from air including the scattering toner suctioned from the suctioning ports; and, an exhaust portion including an airflow exhaust duct for discharging the air having passed through the filter and the air having passed through the forced draft duct to an exhaust port.

With this configuration, it is possible to collect the scattering toner that is sufficiently separated from the carrier by suctioning the toner scattering around the developing area where the photoreceptor drum as the latent image bearing member and the developing roller abut each other, from the lower side of the carrier collecting roller. Accordingly, it is possible to prevent filter clogging and reduction of the carrier, which would occur when the toner together with carrier particles is suctioned. Further, it is possible to obtain a cooling effect of the developing unit by applying the air from the duct onto the bottom of the developing vessel through the forced draft duct.

In addition to the above configuration, in the cooling portion, a forced draft entrance as an inlet of the forced draft duct may be arranged on one end side with respect to the axial direction of the developing roller and a forced draft exist as an outlet of the forced draft duct may be arranged on the other end side, and the forced draft duct may be formed so as to cover substantially the whole surface of the bottom of the developing vessel.

With the above arrangement, since the bottom of the developing unit can be cooled as a whole by arranging the cooling portion and the suction portion separately in two layers, it is possible to markedly enhance the cooling effect of the developing unit.

In addition to the above configuration, the suctioning ports may be arranged on the lower side at both ends of the carrier collecting roller.

With the above configuration, suctioning can be performed selectively from both ends of the carrier collecting roller, at which toner scattering is most prone to occur, it is hence possible to prevent any wasteful increase in the suctioning load on the suctioning portion.

In addition to the above configuration, it is possible to provide a configuration such that the air streams containing the scattering toner suctioned from the suctioning ports are converged to one at the previous stage of the filter and led through the filter, and the filter has a structure that can be inserted into and removed from the suctioning portion.

With the above configuration, since the suctioning duct is formed so as to suction air from both ends towards the center to thereby realize more smooth suction of scattering toner, this configuration makes it possible to prevent toner and the like from building up inside the suctioning duct as well as to make filter maintenance easy.

In addition to the above configuration, the suctioning duct and the forced draft duct may be joined to a single airflow passage, and the fan may be arranged at only one place inside the single airflow passage.

With this configuration, provision of a single fan at the exhaust port makes it possible for the fan to be used for both cooling and suction.

In addition to the above configuration, the turning parts of the suctioning duct, the cooling duct and the exhaust duct may be formed with rounded corners.

With the above configuration, flow of air in each duct passage can be smoothened so that the effect of suctioning, cooling and exhausting can be enhanced more distinctively.

In addition to the above configuration, the bottom of the developing vessel may be formed of aluminum.

Since this configuration enhances the cooling effect, it is possible to prevent change of the developer characteristics, change of image quality and troubles of the developing unit due to solidification of the developer inside the developing unit, which would be caused by change of the temperature around the developing unit.

In addition to the above configuration, a pressure adjustment filter for adjusting the pressure inside the developing vessel may be provided in the developing vessel.

Since the filter works as a pressure reliever when the pressure inside the developing unit has increased, this configuration can suppress toner scattering.

In order to solve the above problems, the present technology resides in an image forming apparatus including the above described developing unit.

With the above configuration, the occurrence of toner scattering around the developing area in the image forming apparatus during development can be suppressed even with use of the carrier and developer that are downsized in diameter, hence it is possible to reduce the printout degradation of the images formed on recording paper etc. in the image forming apparatus. Further, since a sufficient cooling effect against temperature increase of the developing unit due to high-speed operations can be obtained, it is possible to prevent change of developer characteristics and change of image quality and other problems due to change of the surrounding temperature of the developing unit.

As has been described above, it is possible to achieve sufficient cooling by performing suctioning of scattering toner and cooling of the developing vessel using separate channels. Further, since scattering toner inside the image forming apparatus is suctioned from the lower side at both ends of the carrier collecting roller, it is possible to suction the toner particles only after the sufficient separation of the carrier from the toner, which was previously not sufficient. As a result, it is possible to prevent filter clogging and carrier reduction which would occur when the toner is suctioned with inclusion of the carrier.

BRIEF DESCRIPTION OF THE DRAWINGS

FIG. 8 is a table showing various setting conditions in an aging test with a developing unit of the same embodiment;

DESCRIPTION OF THE PREFERRED EMBODIMENTS

Figure 1:
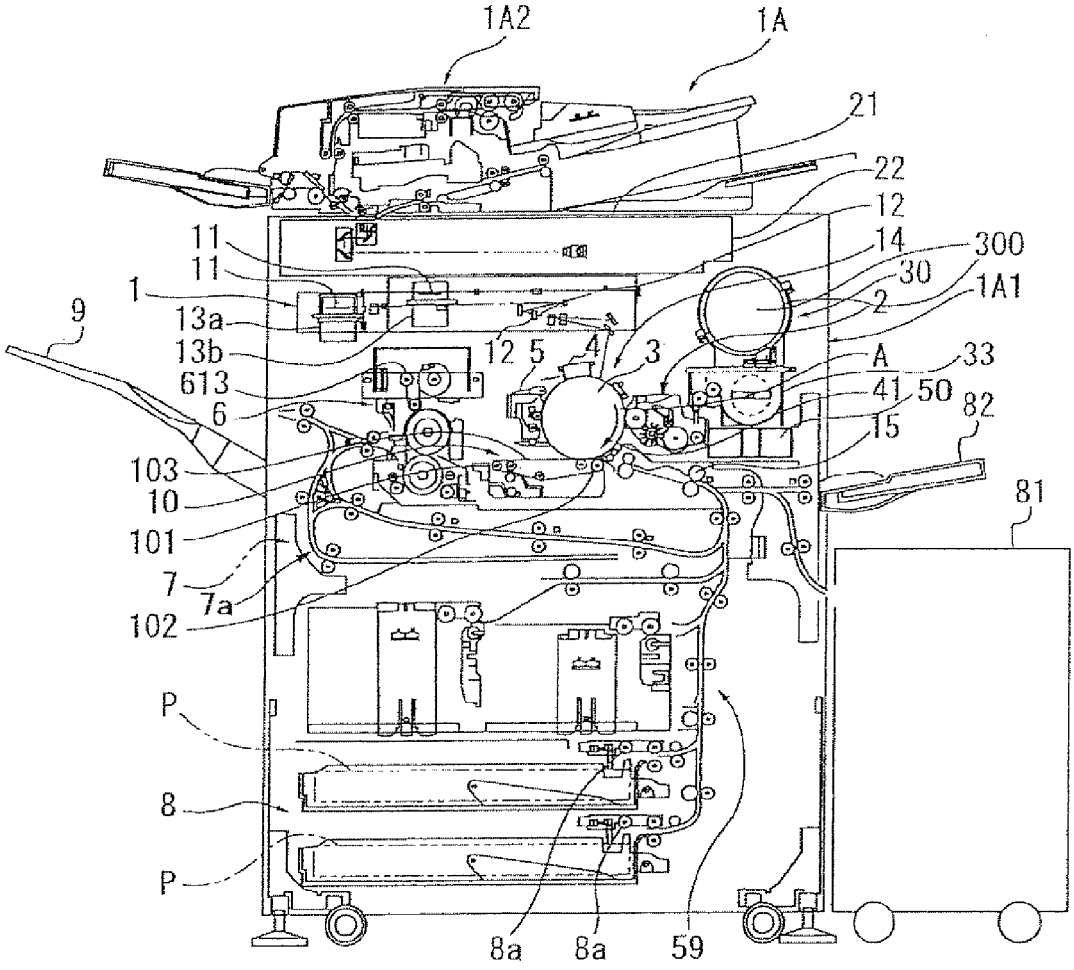
FIG. 1 is an illustrative view showing an overall configuration of an image forming apparatus in which a developing unit is used.

Preferred embodiments will hereinafter be described with reference to the accompanying drawings. In the specification and drawings herein, components having substantially the same functions and configurations are allotted with the same reference numerals so that repeated description will be omitted.

Figure 2:
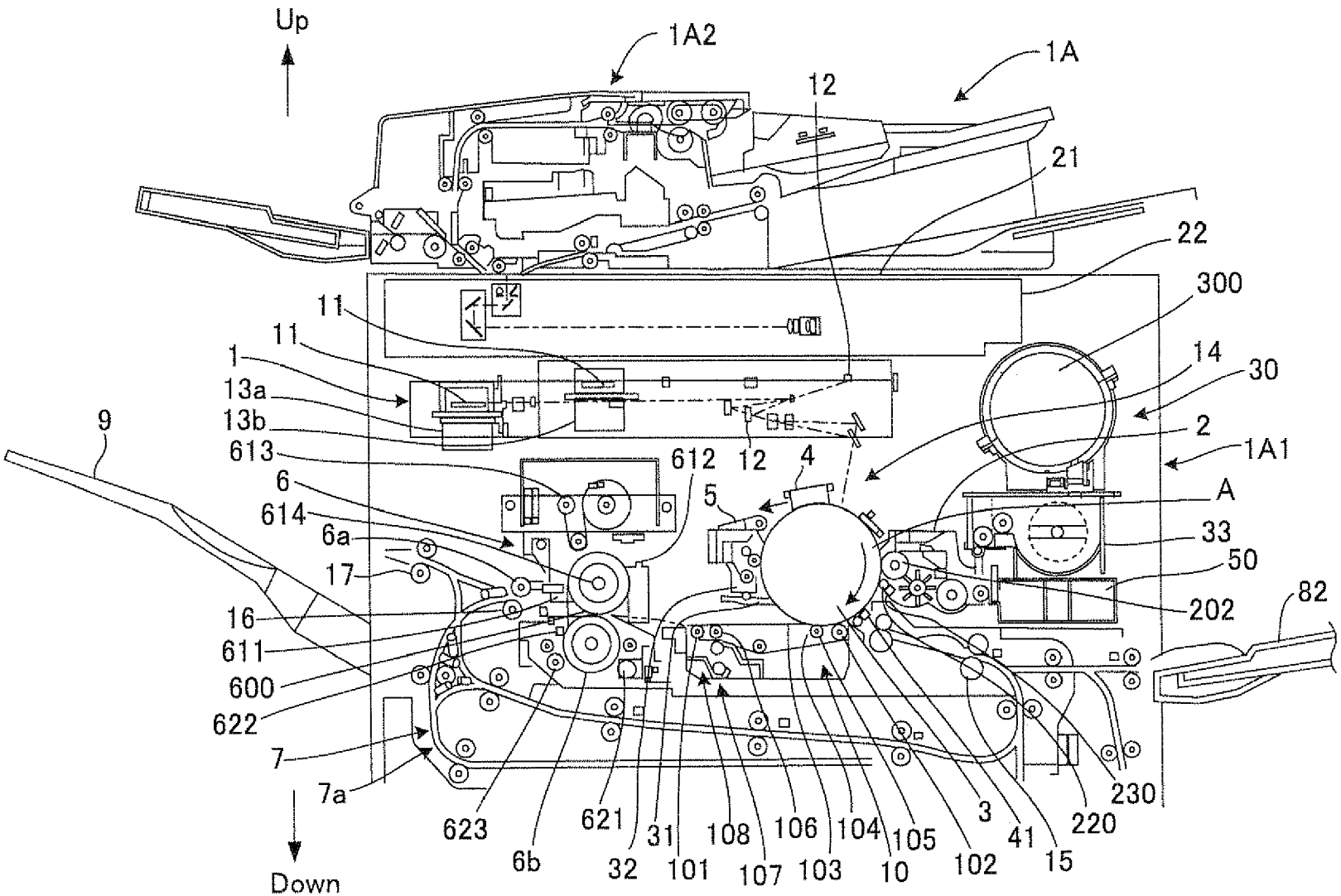
FIG. 2 is a partial detailed view showing the configuration of the apparatus body of the image forming apparatus of the same embodiment.

The configuration of the first embodiment of an image forming apparatus in which a developing unit is used will be described with reference to the drawings. FIG. 1 is an illustrative view showing an overall configuration of the first embodiment of an image forming apparatus in which a developing unit of the present invention is used. FIG. 2 is a partial detailed view showing the configuration of the apparatus body of the same image forming apparatus.

As shown in FIGS. 1 and 2 an image forming apparatus 1A is an image forming apparatus that processes image data captured by a scanner etc., or image data transmitted from without to output a monochrome (single color) image, based on the electrophotography, by forming an electrostatic latent image on a rotationally driven, cylindrical photoreceptor drum (latent image bearing member) 3, developing the electrostatic latent image into a visualized developer image with an electrified developer prepared by mixing two components, or an electrostatically chargeable toner and magnetic carrier, and transferring the developed image to a predetermined sheet of recording paper (to be referred to as paper hereinbelow) as a recording medium. This image forming apparatus 1A adopts, as its developing device for visualizing the electrostatic latent image on photoreceptor drum 3, a developing unit 2, which is distinctive in the present technology, including a carrier collecting roller 220 (FIG. 2) for collecting the magnetic carrier having adhered on photoreceptor drum 3 and a carrier removing device (carrier remover) 230 (FIG. 2) for removing the magnetic carrier collected by carrier collecting roller 220 therefrom.

This image forming apparatus 1A includes a paper feed tray 8 which can stack multiple sheets of paper P (FIG. 1) thereon; a paper conveying portion 59 for conveying paper P fed from this paper feed tray 8 to an image forming portion 14; and a paper conveyor system 7 for conveying the paper P with an unfixed toner image printed thereon by image forming portion 14 to a fixing unit 6 where the unfixed toner is fused and fixed onto the paper. The image forming apparatus, based on the conveying speeds of paper P corresponding to a multiple number of preset printout processing modes, can select and control the conveying speed of paper P in accordance with a print request and automatically convey paper P from paper feed tray 8 to a paper output tray 9.

First, the overall configuration of image forming apparatus 1A will be described. Image forming apparatus 1A is essentially composed of, as shown in FIG. 1, an apparatus body 1A1 including a light exposure unit 1, developing unit 2, a toner feed device 30, photoreceptor drum 3, a charger 4, a charge erasing device 41, a cleaner unit 5, a fixing unit 6, paper conveyor system 7, a paper feed path 7*a*, paper feed tray 8, paper output tray 9, a transfer device 10 and the like, and an automatic document processor 1A2.

Provided at the top of apparatus body 1A1 is an original placement table 21 made of transparent glass on which a document is placed. Automatic document processor 1A2 is arranged on the top of this original placement table 21 so that it can pivotally open upwards, while a scanner portion 22 as a document reader for reading image information of originals is arranged under this original placement table 21.

Arranged below scanner portion 22 are light exposure unit 1, developing unit 2, photoreceptor drum 3, charger 4, charge erasing device 41, cleaner unit 5, fixing unit 6, paper conveyor system 7, paper feed path 7*a*, paper output tray 9 and transfer device 10. Further, paper feed tray 8 that accommodates paper P therein is arranged under these.

Light exposure unit 1 provides a function of emitting laser beam in accordance with the image data output from an unillustrated image processor to irradiate the photoreceptor drum 3 surface that has been uniformly electrified by charger 4 to thereby write and form an electrostatic latent image corresponding to the image data on the photoreceptor drum 3 surface. This light exposure unit 1 is arranged directly under scanner portion 22 and above photoreceptor drum 3, and includes laser scanning units (LSUs) 13*a* and 13*b* including laser emitters 11 and a reflection mirror 12. In the present embodiment, in order to support high-speed printing operation, multiple laser beams from multiple laser emitters 11 are used to reduce the irradiation frequency of each laser beam (the processing load of each laser beam per unit time is reduced). More specifically, a two-beam technique using a pair of laser emitters 11 to emit two laser beams is adopted. Here, in the present embodiment laser scanning units (LSUs) 13*a* and 13*b* are used for light exposure unit 1, but an array of light emitting elements, e.g., an EL (electroluminescence) or LED (light-emitting diode) writing head may also be used.

Photoreceptor drum 3 has an approximately cylindrical shape, is arranged under light exposure unit 1 and is controlled so as to rotate in a predetermined direction (in the direction of arrow A in the drawing) by an unillustrated driver and controller. Arranged along the peripheral surface of this photoreceptor drum 3, starting from the position at which image transfer ends downstream in the rotational direction of the photoreceptor drum are, as shown in FIG. 2, a paper separation claw 31, cleaner unit 5, charger 4 as an electric field generator, developing unit 2 and charge erasing device 41 in the order mentioned.

Paper separation claw 31 is disposed so as to be moveable into and out of contact with the outer peripheral surface of photoreceptor drum 3 by means of a solenoid 32. When this paper separation claw 31 is put in abutment with the outer peripheral surface of photoreceptor drum 3, it functions to peel off the paper P that has adhered to the photoreceptor drum 3 surface during the unfixed toner image on photoreceptor drum 3 being transferred to the paper P. Here, as a driver for paper separation claw 31, a drive motor or the like may be used instead of solenoid 32, or any other driver may also be selected.

Developing unit 2 visualizes the electrostatic latent image formed on photoreceptor drum 3 with black toner, and is arranged at approximately the same level at the side (on the right side in the drawing) of photoreceptor drum 3 downstream of charger 4 with respect to the rotational direction of the photoreceptor drum (in the direction of arrow A in the drawing). A registration roller 15 is disposed under this developing unit 2 on the upstream side with respect to the recording medium's direction of conveyance. This developing unit 2 will be detailed later.

Carrier collecting roller 220 is arranged under developing unit 2 to collect magnetic carrier particles adhering on photoreceptor drum 3. Carrier removing device 230 has the function of removing magnetic carrier collected by carrier collecting roller 220 from carrier collecting roller 220.

Toner feed device 30 temporarily holds the toner discharged from a toner container 300 filled with toner, in an intermediate hopper 33 and then supplies it to developing unit 2. This toner feed device is arranged adjacent to developing unit 2. Provided under this toner feed device 30 is a duct unit 50 which includes an unillustrated air blowing fan for sending air to a developing vessel 200 of developing unit 2 in order to forcibly cool or remove operational heat that arises while developing unit 2 is operated. The detail of duct unit 50 will be described later.

Registration roller 15 is operated and controlled by an unillustrated driver and controller so as to convey the paper P delivered from paper feed tray 8 into and between photoreceptor drum 3 and a transfer belt 103 whilst making the leading end of the paper P register with the toner image on the photoreceptor drum 3.

Charger 4 is a charging device for uniformly charging the photoreceptor drum 3 surface at a predetermined potential, and is arranged over photoreceptor drum 3 and close to the outer peripheral surface thereof. Here, a discharge type charger 4 is used in the present embodiment, but a contact roller type or a brush type may be used instead.

Charge erasing device 41 is a pre-transfer erasing device for lowering the surface potential of the photoreceptor drum 3 in order to facilitate the toner image formed on the photoreceptor drum 3 surface to transfer to paper P, and is laid out on the downstream side of developing unit 2 with respect to the photoreceptor drum's direction of rotation and under photoreceptor drum 3 and close to the outer peripheral surface of the same. Though in the present embodiment, charge erasing device 41 is configured using a charge erasing electrode, a charge erasing lamp or any other method can be used instead of the charge erasing electrode.

Cleaner unit 5 removes and collects the toner left on the surface of photoreceptor drum 3 after development and image transfer, and is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper P being conveyed whilst the paper is being applied by transfer device 10 with an electric field having an opposite polarity to that of the electric charge of the electrostatic image. For example, when the electrostatic image bears negative (−) charge, the applied polarity of transfer device 10 should be positive (+).

Transfer device 10 is provided as a transfer belt unit in which transfer belt 103 having a predetermined resistivity (ranging from $1\times10^{9}$ to $1\times10^{13}$ Ω·cm in the embodiment) is wound and tensioned on a drive roller 101, a driven roller 102 and other rollers, and is disposed under photoreceptor drum 3 with the transfer belt 103 surface put in contact with part of the outer peripheral surface of photoreceptor drum 3. This transfer belt 103 conveys paper P while pressing the paper against photoreceptor drum 3. An elastic conductive roller 105 having a conductivity different from that of drive roller 101 and driven roller 102 and capable of applying a transfer electric field is laid out at a contact point 104 where transfer belt 103 comes into contact with photoreceptor drum 3.

Elastic conductive roller 105 is composed of a soft material such as elastic rubber, foamed resin etc. Since this elasticity of elastic conductive roller 105 permits photoreceptor drum 3 and transfer belt 103 to come into, not line contact, but area contact of a predetermined width (called a transfer nip) with each other, it is possible to improve the efficiency of transfer to the paper P being conveyed.

Further, a charge erasing roller 106 for erasing the electric field that has been applied to the paper P as it was being conveyed through the transfer area so as to achieve smooth conveyance of the paper to the subsequent stage is disposed on the interior side of transfer belt 103, on the downstream side, with respect to the direction of paper conveyance, of the transfer area of transfer belt 103.

As shown in FIG. 2, transfer device 10 also includes a cleaning unit 107 for removing dirt due to leftover toner on transfer belt 103 and a plurality of charge erasing devices 108 for erasing electricity on transfer belt 103. Erasure of charge by erasing devices 108 may be performed by grounding via the apparatus or by positively applying charge of a polarity opposite to that of the transfer field.

The paper P with the static image (unfixed toner) transferred thereon by transfer device 10 is conveyed to fixing unit 6, where it is pressed and heated so as to fuse the unfixed toner and fix it to the paper P. This fixing unit 6 includes a heat roller 6*a* and a pressing roller 6*b* as shown in FIG. 2 and fuses and fixes the toner image transferred on paper P by rotating heat roller 6*a* so as to convey the paper P held between heat roller 6*a* and pressing roller 6*b* through the nip therebetween. Arranged on the downstream side of fixing unit 6 with respect to the direction of paper feed is a conveyance roller 16 for conveying paper P. Also, a paper discharge roller 17 for discharging paper P to paper output tray 9 is arranged on the downstream side of this conveyance roller 16 with respect to the direction of paper feed.

Heat roller 6*a* has a sheet separation claw 611, a thermistor 612 as a roller surface temperature detector and a roller surface cleaning member 613, all arranged on the outer periphery thereof and also includes a heat source 614 for heating the heat roller surface at a predetermined temperature (set fixing temperature: approximately 160 to 200 deg. C.) in the interior part thereof.

Pressing roller 6*b* is provided at its each end with a pressing element 621 capable of abutting the pressing roller 6*b* with a predetermined pressure against heat roller 6*a*. In addition a sheet separation claw 622 and a roller surface cleaning element 623 are provided on the outer periphery of pressing roller 6*b*, similarly to the outer periphery of heat roller 6*a*.

In this fixing unit 6, as shown in FIG. 2 the unfixed toner on the paper P being conveyed is heated and fused by heat roller 6*a*, at the pressed contact (so-called fixing nip portion) 600 between heat roller 6*a* and pressing roller 6*b*, so that the unfixed toner is fixed to the paper P by the anchoring effect to the paper P by the pressing force from heat roller 6*a* and pressing roller 6*b*.

As shown in FIG. 1, paper feed tray 8 stacks a plurality of sheets (paper) to which image information will be output (printed), and is arranged under image forming portion 14 made up of light exposure unit 1, developing unit 2, photoreceptor drum 3, charger 4, charge erasing device 41, cleaner unit 5, fixing unit 6 etc. A paper pickup roller 8*a* is disposed at an upper part on the paper output side of this paper feed tray 8.

This paper pickup roller 8*a* picks up paper P, sheet by sheet, from the topmost of a stack of paper stored in paper feed tray 8, and conveys the paper downstream (for convenience' sake, the supply side of paper P (the cassette side) is referred to as upstream and the paper output side is referred to as downstream) to the registration roller (also called "idle roller") 15 side in paper feed path 7*a*.

Since the image forming apparatus 1A according to the present embodiment is aimed at performing high-speed printing operations, a multiple number of paper feed trays 8 each capable of stacking 500 to 1500 sheets of standard-sized paper P are arranged under image forming portion 14. Further, a large-capacity paper feed cassette 81 capable of storing multiple kinds of paper in large volumes is arranged at the side of the apparatus while a manual feed tray 82 for essentially supporting printing etc. for irregular sized paper is arranged over the large-capacity paper feed cassette 81.

Paper output tray 9 is arranged on the opposite side across the apparatus from that of manual feed tray 82. It is also possible to configure such a system that instead of paper output tray 9, a post-processing machine for stapling, punching of output paper and the like and/or a multi-bin paper output tray etc., may be arranged as an option.

Paper conveyor system 7 is laid out between the aforementioned photoreceptor drum 3 and paper feed tray 8, and conveys paper P supplied from paper feed tray 8, sheet by sheet, by way of paper feed path 7*a* included in paper conveyor system 7, to transfer device 10, where a toner image is transferred from photoreceptor drum 3 to the paper, further conveying it to fixing unit 6 where the unfixed toner image is fixed to the paper, then conveys the sheet as it is being guided by paper feed paths and branch guides, in accordance with the designated paper output processing mode.

In the image forming apparatus 1A according to the present embodiment, two predetermined output processing modes, namely, one-sided printing mode and two-sided printing mode are prepared. In one-sided printing mode, there are two ways of paper output, i.e., the faceup output by which the paper is discharged with its printed surface faceup and the facedown output by which the paper is discharged with its printed surface facedown.

Figure 3:
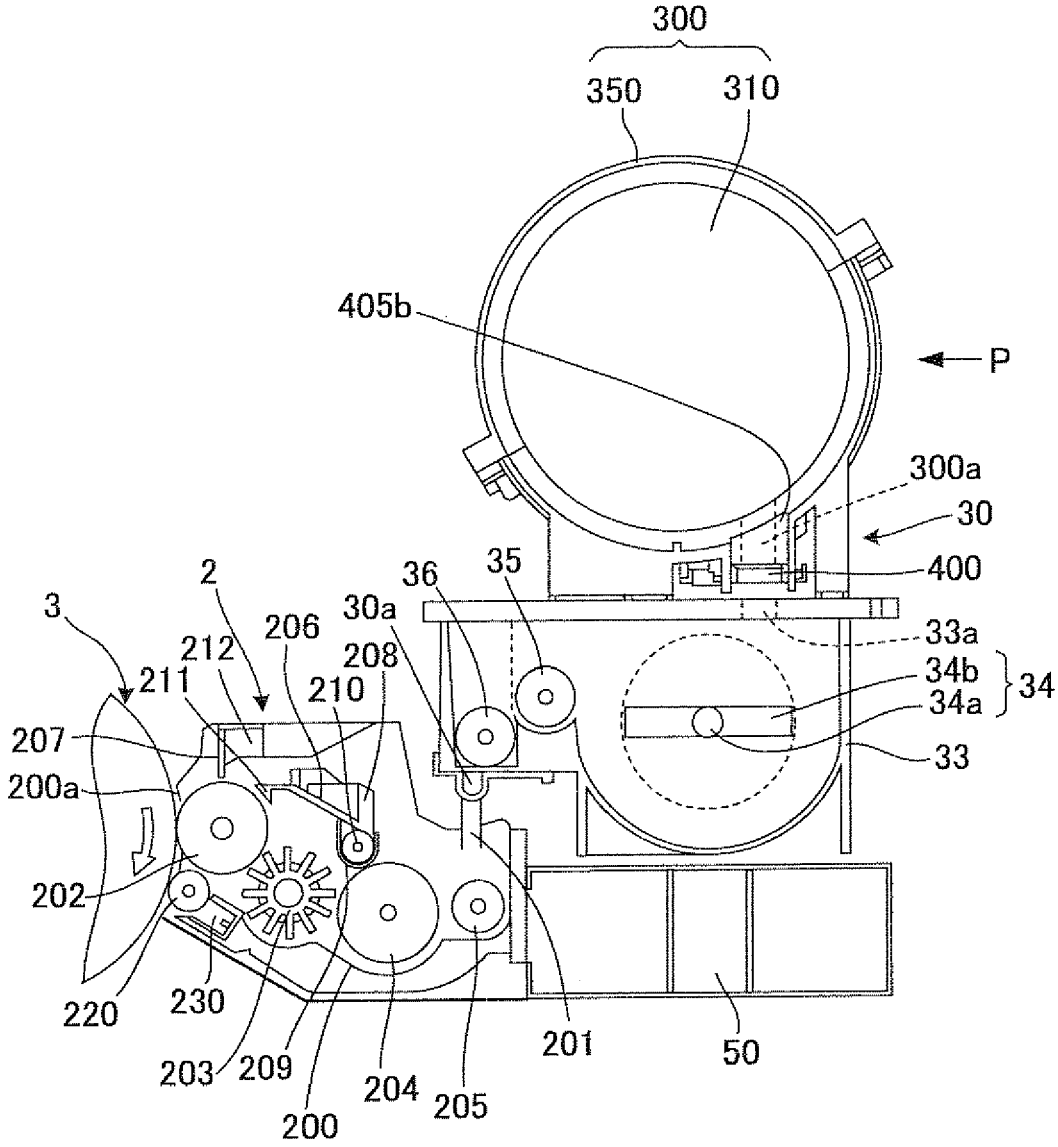
FIG. 3 is a schematic configurational side view showing a developing unit and toner feed device that are arranged in the image forming apparatus of the same embodiment.

Next, developing unit 2 and its peripheral components that constitute image forming apparatus 1A according to the present embodiment will be described with reference to the drawings. FIG. 3 is a schematic configurational side view showing the developing unit and toner feed device that are included in the image forming apparatus according to the present embodiment.

In this embodiment, as shown in FIG. 3, toner feed device 30 is arranged adjacent to developing unit 2. Duct unit 50 having an air blowing fan or the like for sending air to a developing vessel 200 that forms the exterior of developing unit 2 is provided under this toner feed device 30 in order to forcibly remove operational heat that arises while developing unit 2 is operated.

As shown in FIG. 3, in developing unit 2 a toner input port 201 for leading toner is formed, at a position where opening 30*a* for supplying toner from toner feed device 30 abuts the developing vessel 200 that forms its exterior. This developing vessel 200 incorporates developer roller 202, a paddle roller 203, a mixing roller 204, a conveying roller 205, a partitioning plate 206 and a regulating member 207. Developing unit 2 is mounted inside image forming apparatus 1A in such a manner that the peripheral surface (the developer adhering on the peripheral area) of developing roller 202 opposes in contact with the peripheral surface of photoreceptor drum 3. That is, the peripheral surface area of developing roller 202 opposing in contact with photoreceptor drum 3 forms the developing position. Further, arranged adjacent to and under developing roller 202 in the opening, designated at 200*a* of developing vessel 200 is carrier removing device 230 including carrier collecting roller 220 for collecting carrier adhering on photoreceptor drum 3.

In developing vessel 200, the toner that was fed from toner feed device 30 and input through toner input port 201 is conveyed by conveying roller 205 to mixing roller 204, where the toner is mixed with magnetic carrier to thereby prepare a dual-component developer. Mixing roller 204 mixes this newly formed dual-component developer with the surplus developer that is returned by the aforementioned partitioning plate 206. The developer thus obtained by mixing with mixing roller 204 is tribo-electrified as it is agitated by paddle roller 203, then supplied to developing roller 202 for developing electrostatic latent images and further conveyed to the electrostatic latent image formed on photoreceptor drum 3.

The developer to be supplied to developing roller 202 is first rubbed and pre-charged by a rubbing member 211 that is integrally formed at one end side of partitioning plate 206 whilst being regulated as to the amount of conveyance (layer thickness) thereby. Then, the layer thickness of the developer being conveyed by developing roller 202 is further controlled by regulating member 207 that is supported by a supporting member 212 as a part of developing vessel 200. In this way, the supplied amount of developer is regulated and the excluded, surplus developer is returned in directions going away from regulating member 207 by partitioning plate 206 that functions as a recirculating plate for returning surplus developer. These regulating member 207, rubbing member 211 and partitioning plate 206 are formed to be as long as developing roller 20.

Further, a plurality of rectifying plates 208 are formed on the upper side of partitioning plate 206 while a partitioning plate-side conveyor 209 which conveys surplus developer by a conveyor screw 210 is arranged on the lower side of partitioning plate 206. Details of these components provided in developing unit 2 will be described later.

Toner feed device 30 is arranged adjacent to developing unit 2, and temporarily reserves the toner discharged from toner container 300 filled with toner, in intermediate hopper 33 and then feeds the toner to developing unit 2. In the present embodiment, toner container 300 is configured so that its container body 310 charged with toner is rotatably supported by a supporting structure 350.

The toner thus sent out to intermediate hopper 33 is agitated therein by an agitator 34 first. Agitator 34 is comprised of an agitator shaft 34*a* and agitating vanes 34*b* attached thereto. As agitator shaft 34*a* turns, agitating vanes 34*b* rotate about agitator shaft 34*a* to thereby agitate the toner in intermediate hopper 33 that has been fed from toner container 300.

The toner thus agitated by agitator 34 is sent by the agitating action of agitator 34 and conveyed to the feed roller 36 side via a conveying roller 35. Feed roller 36 sends out the toner that has been conveyed from agitator 34 via conveying roller 35, to opening 30*a* that is formed at the position where intermediate hopper 33 abuts developing unit 2, to thereby supply the toner to developing unit 2.

Provided on the bottom side (the underside when toner container 300 is mounted on image forming apparatus 1A) of supporting structure 350 of toner container 300 is a shutter opening and closing mechanism 400 for opening and closing a toner feed aperture 300*a* through which toner supplied from toner container 300 is discharged out of supporting structure 350, as shown in FIG. 3. Specifically, as toner feed aperture 300*a* of supporting structure 350 is released by shutter opening and closing mechanism 400, passage between toner feed aperture 300*a* and opening 33*a* provided for intermediate hopper 33 is communicated, so that the toner discharged from toner container 300 is supplied to intermediate hopper 33.

Figure 4:
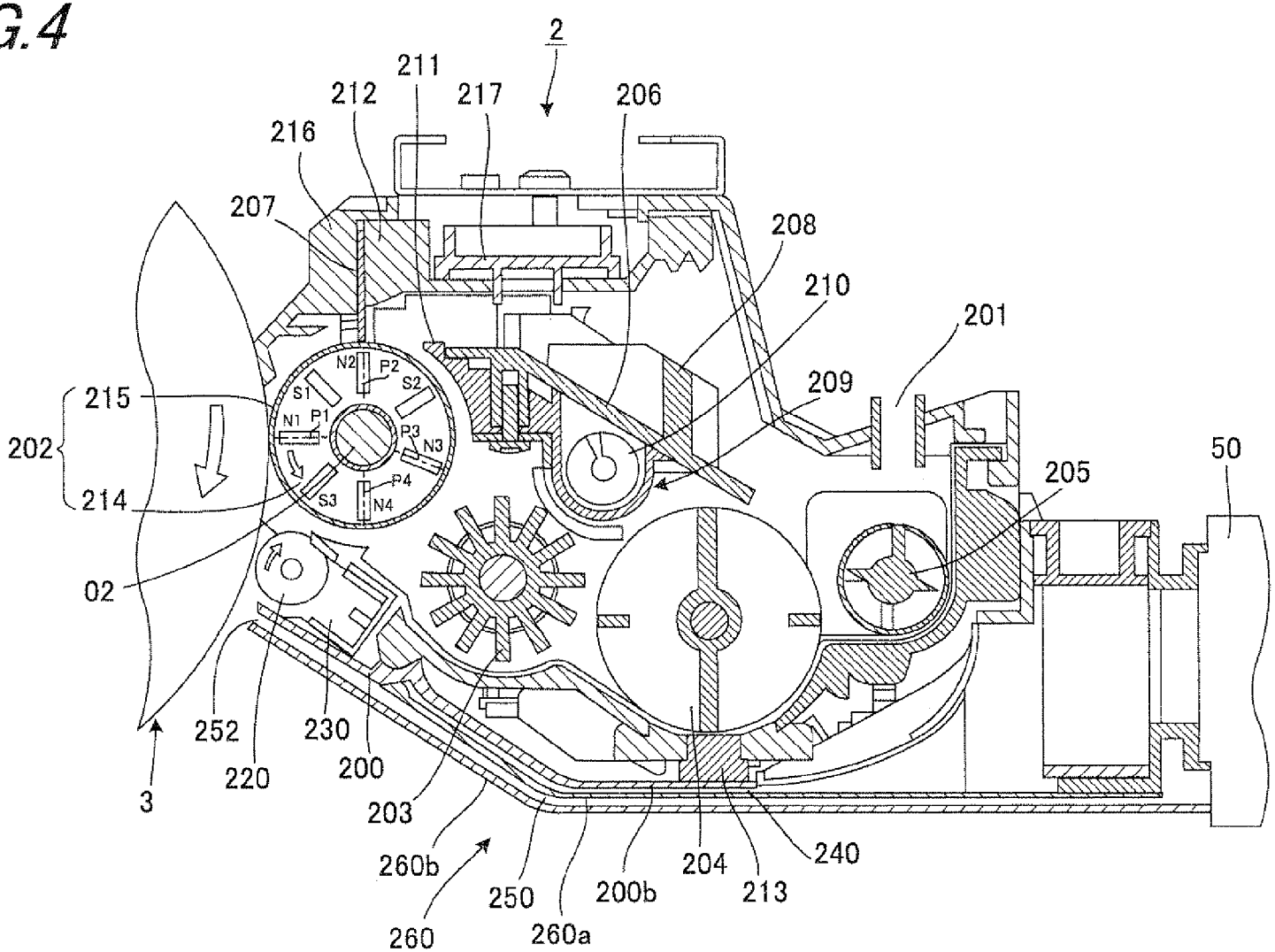
FIG. 4 is a sectional view showing the configuration of the developing unit of the same embodiment.
Figure 5A:
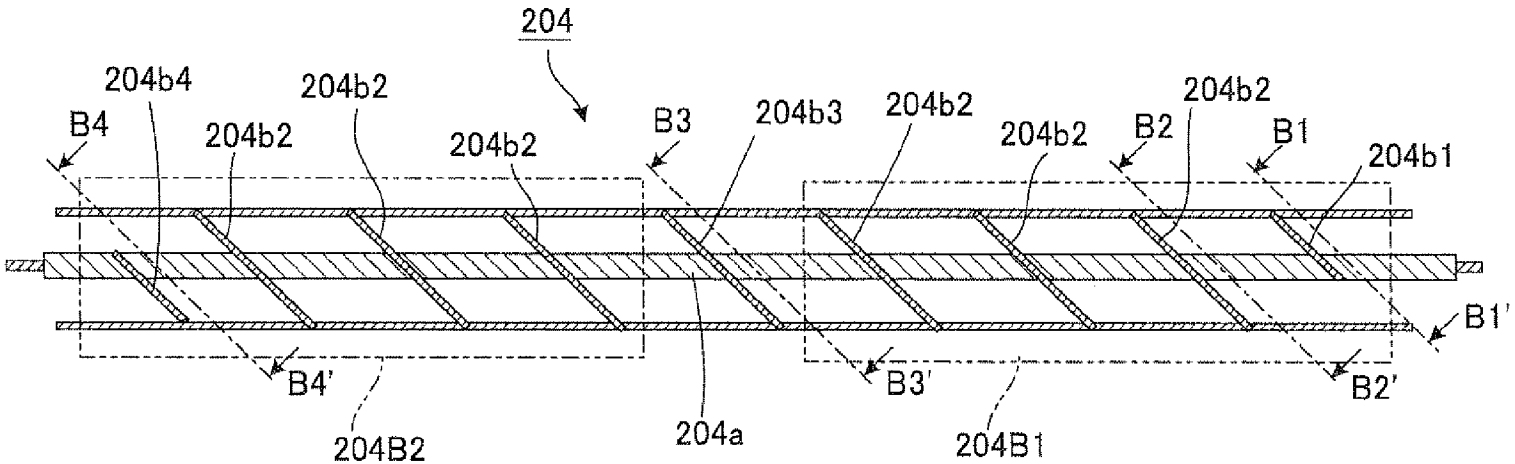
FIG. 5A is a sectional side view showing a configuration of a mixing roller that constitutes the developing unit of the same embodiment.
Figure 5B:
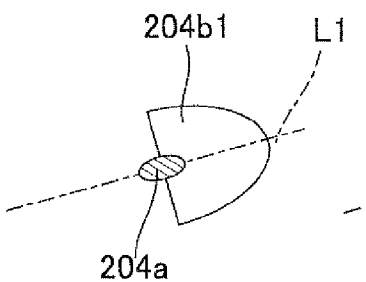
FIG. 5B is a sectional view cut along a plane B1-B1' in FIG. 5A.
Figure 5C:
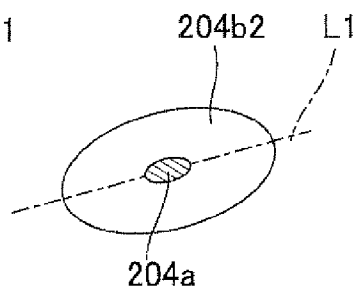
FIG. 5C is a sectional view cut along a plane B2-B2' in FIG. 5A.
Figure 5D:
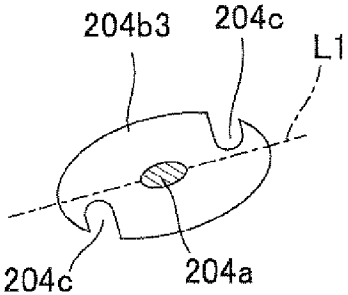
FIG. 5D is a sectional view cut along a plane B3-B3' in FIG. 5A.
Figure 5E:
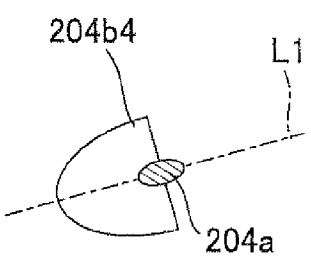
FIG. 5E is a sectional view cut along a plane B4-B4' in FIG. 5A.

Next, the characteristic configuration of developing unit 2 according to the present embodiment will be described in detail with reference to the drawings. FIG. 4 is a sectional view showing the configuration of the developing unit according to the present embodiment; FIG. 5A is a side sectional view showing a configuration of a mixing roller that constitutes the developing unit; FIG. 5B is a sectional view cut along a plane B1-B1' in FIG. 5A; FIG. 5C is a sectional view cut along a plane B2-B2' in FIG. 5A; FIG. 5D is a sectional view cut along a plane B3-B3' in FIG. 5A; and FIG. 5E is a sectional view cut along a plane B4-B4' in FIG. 5A.

As shown in FIG. 4, developing unit 2 includes developing vessel 200 forming its exterior, and toner input port 201 for leading toner is formed in this developing vessel 200 at a position where opening 30*a* (FIG. 3) provided for toner feed device 30 to deliver toner abuts the developing vessel 200. This developing vessel 200 reserves the developer therein and incorporates developer roller 202, paddle roller 203, mixing roller 204, conveying roller 205, a regulating member 207 and collecting roller 220.

Developing unit 2 is mounted inside image forming apparatus 1A in such a manner that the peripheral surface (the developer adhering on the peripheral area) of developing roller 202 that is partly exposed from developing vessel 200 opposes in proximity to the peripheral surface of photoreceptor drum 3. That is, the peripheral surface area of developing roller 202 opposing photoreceptor drum 3 forms the developing position (developing area).

In developing vessel 200, the toner that was fed from toner feed device 30 (FIG. 3) and input through toner input port 201 is conveyed by conveying roller 205 to mixing roller 204, where the toner is mixed with the magnetic carrier to thereby prepare a dual-component developer. Mixing roller 204 mixes the aforementioned newly formed dual-component developer with the existing developer inside developing vessel 200. The developer obtained by mixing with mixing roller 204 is tribo-electrified as it is agitated by paddle roller 203, then supplied to developing roller 202 for developing electrostatic latent images, and conveyed by developing roller 202 to the electrostatic latent image formed on photoreceptor drum 3. The developer supplied to developing roller 202 and conveyed thereby is controlled as to its layer thickness by regulating member 207 that is supported by supporting member 212 as a part of developing vessel 200. In this way, the amount of developer to be supplied to photoreceptor drum 3 is regulated.

In order to make the forced air-cooling by duct unit 50 more efficient, developing vessel 200 is made of a metallic material having a high thermal conductivity such as aluminum or the like as a countermeasure against increase in temperature inside developing unit 2, and has opening 200*a* (FIG. 3) facing (opposing) the peripheral surface of photoreceptor drum 3.

Provided on the upper outside part of supporting member 212 that forms the top of developing vessel 200 is a pressure relief mechanism (pressure adjustment filter) 217 for reducing the pressure inside developing vessel 200. This pressure relief mechanism 217 is periodically operated to release the pressure inside developing unit 2 so that toner scattering inside the apparatus can be prevented. Here, the attached position of pressure relief mechanism 217 is not limited to the top of developing vessel 200. For example, the mechanism may be arranged on the flank or at the bottom of developing vessel 200 as long as it can release the pressure inside developing vessel 200.

Developing roller 202 is arranged at the position inside developing vessel 200 where opening 200*a* is formed while conveying roller 205 that conveys the developer (toner) supplied from toner input port 201 into developing vessel 200 to mixing roller 204 is disposed rotatably at a position that opposes toner input port 201.

A toner concentration sensor 213 for detecting the toner concentration inside developing vessel 200 is provided at the bottom opposing the lower side of mixing roller 204 in developing vessel 200. Image forming apparatus 1A is configured so as to supply toner from toner input port 201 based on the measurement of toner concentration sensor 213 when the amount of toner being mixed and agitated by mixing roller 204 becomes lower than the proper amount.

Arranged within opening 200*a* of developing vessel 200, adjacent to and below developing roller 202 is carrier collecting roller 220 for collecting the magnetic carrier that has transferred to photoreceptor drum 3. More specifically, carrier collecting roller 220 is arranged at a position downstream of developing roller 202 with respect to the rotational direction of photoreceptor drum 3 and positioned a small gap of about 1 mm apart from photoreceptor drum 3. Also, carrier removing device 230 which removes the magnetic carrier collected by this carrier collecting roller 220 therefrom is disposed at a position on the upstream side with respect to the carrier collecting roller 220's direction of rotation.

Figure 6:
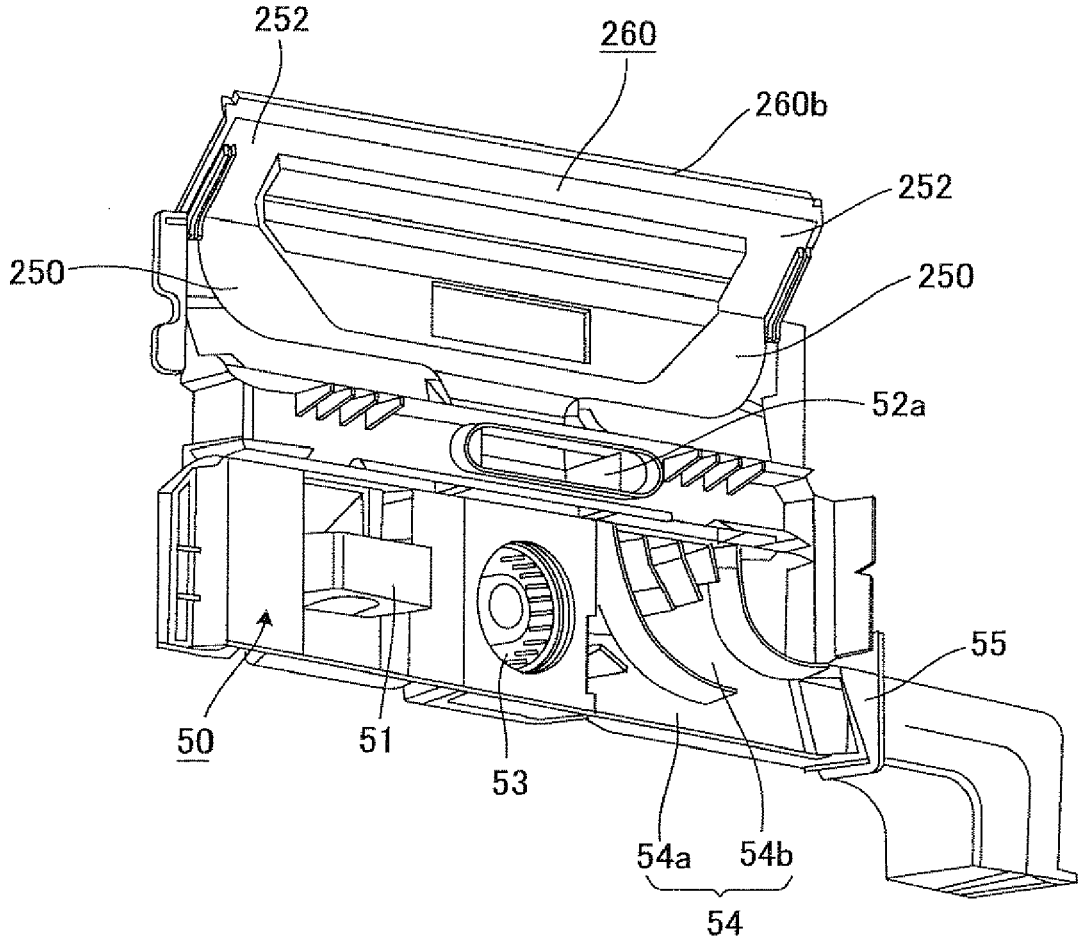
FIG. 6 is a perspective view showing a configuration of an exterior wall 260*b* that defines a suctioning duct 250 in a base structure of the developing unit of the same embodiment.

In the present embodiment, as shown in FIGS. 4 and 6, a forced draft duct 240 for airflow from the blowing fan of duct unit 50 is arranged under the bottom, designated at 200*b*, of developing vessel 200, as a cooling portion for forcibly cooling the operating heat that arises while developing unit 2 is being operated. Formed under this forced draft duct 240 is a suctioning duct 250 for airflow from suctioning ports 252 disposed at both ends and on the lower side of carrier collecting roller 220 to a suctioning fan 53 (FIG. 6) as a suctioning portion for suctioning scattering toner near the developing area of developing unit 2.

Though in the present embodiment, these forced draft duct 240 and suctioning duct 250 are integrally formed with base structure 260 that supports developing vessel 200 of developing unit 2, forced draft duct 240 and suctioning duct 250 may be formed separately as long as they are formed in a double-layered structure in which forced draft duct 240 is formed on the upper layer side in proximity with bottom 200*b* of developing vessel 200 and suctioning duct 250 is formed on the lower layer side under forced draft duct 240. The detailed configuration of base structure 260 that is integrally formed with forced draft duct 240 and suctioning duct 250 will be described later.

As shown in FIG. 4, developing roller 202 is arranged a development gap (about 0.5 to 1.5 mm) apart from photoreceptor drum 3. Developing roller 202 is formed of a magnet roller 214 with multiple magnetic poles and a non-magnetic sleeve 215 that is approximately cylindrically formed of an aluminum alloy, brass and the like and is arranged rotatably over, and relative to the magnet roller 214. In this magnetic roller 214, a plurality of bar magnets having rectangular sections, specifically magnetic pole elements N1, N2, N3 and N4 providing N-pole magnetic fields and magnetic pole elements S1, S2 and S3 providing S-pole magnetic fields, are radially arranged apart one from another in the order shown in FIG. 4.

Magnet roller 214 is unrotatably supported and fixed at its both ends by the side walls of developing vessel 200. Magnetic pole element N1 is disposed at a position opposing the peripheral surface of photoreceptor drum 3. Each of the chained lines designated at P1, P2, P3 and P4 of magnetic pole elements N1, N2, N3 and N4 represents the center of the width of the associated magnetic pole element or the central axis of the associated magnetic pole, with respect to the circumferential direction of developing roller 202. These magnetic pole's center axes P1, P2, P3 and P4 are radially extended from the developing roller's central axis O2 and formed across the full length of the magnet elements (across the length of sleeve 215). The magnetic pole element N1 that opposes the peripheral surface of photoreceptor drum 3 is positioned so that the magnetic pole's center axis P1 substantially coincides with the line (plane) that passes through both the center axis (outside the area of FIG. 4) of photoreceptor drum 3 and the center axis O2 of developing roller 202.

The above magnetic pole elements are laid out in the order of N1, S3, N4, N3, S2, N2 and S1 in the rotational direction of developing roller 202. The magnetic field created by the thus arranged magnetic pole elements N1, N2, N3, N4, S1, S2 and S3, attracts the dual-component developer particles made of toner and carrier to the peripheral surface of rotating sleeve 215 so as to form brush-like spikes (to be referred as magnetic brush) extending in the circumferential direction of the sleeve. As the photoreceptor drum rotates, the photoreceptor drum 3 surface is rubbed in the above-mentioned development gap area by the magnetic brush created on rotating developing roller 202 to thereby achieve development.

Regulating member 207 controls the amount of the developer conveyed between itself and developing roller 202 while performing principal electrification of the developer, and is formed of a non-magnetic metal plate having an approximately rectangular section. One end of regulating member 207 opposes the outer peripheral surface of developing roller 202 (sleeve 215) with a predetermined gap in between. Regulating member 207 is fixed to a cover element 216 and disposed inside opening 200*a* (FIG. 3). This regulating member 207 is formed of a non-magnetic metal plate such as aluminum, stainless steel or the like.

Mixing roller 204 agitates and conveys the toner supplied from toner feed device 30 (FIG. 3) as shown in FIG. 5A and is comprised of a rotary shaft 204*a* arranged substantially parallel to developing roller 202 (FIG. 4) and a plurality of separate plate-like agitating elements 204*b* (204*b*1 to 204*b*4).

Agitating elements 204*b* are arranged inclined at an angle of approximately 45 degrees with the direction in which the axis of rotary shaft 204*a* extends (to be referred to as the axial direction). Agitating elements 204*b* include agitating element 204*b*3 disposed at the approximate center, with respect to the axial direction, of rotary shaft 204*a*, a group 204B1 of an agitating element 204*b*1 and multiple agitating elements 204*b*2 arranged on the right side in the drawing and a group 204B2 of an agitating element 204*b*4 and multiple agitating elements 204*b*2 arranged on the left side in the drawing. Here, agitating elements 204*b*1 and 204*b*4 are disposed at both ends with respect to the axial direction of rotary shaft 204*a*.

In the present embodiment, group 204B1 includes as many agitating elements 204*b*2 as group 204B2 does. That is, mixing roller 204 has an odd number of agitating elements 204*b*.

As shown in FIGS. 5B and 5E, agitating elements 204*b*1 and 204*b*4 arranged at both ends of rotary shaft 204*a* have approximately semicircular shapes which are point symmetrical with respect to rotary axis 204*a*. Detailedly, agitating elements 204*b*1 and 204*b*4 each have a hemi-elliptic shape by cutting an elliptic shape having a major axis L1 passing through rotary axis 204*a* in half along the line that is substantially perpendicular to the major axis L1.

A plurality of agitating elements 204*b*2 are provided between agitating element 204*b*3 and agitating element 204*b*1 and between agitating element 204*b*3 and agitating element 204*b*4, each being inclined with the axial direction of rotary shaft 204*a* and having a substantially elliptic shape, as shown in FIG. 5C. This configuration makes it possible for each agitating element to produce a stronger conveying force in the direction of the rotary axis.

Agitating element 204*b*3 arranged at the substantially center of rotary shaft 204*a* has a substantially elliptic shape having a cutout portion 204*c* at the position opposing the aforementioned toner concentration sensor 213 as shown in FIG. 5D, so that light for detection from toner concentration sensor 213 is permitted to pass through. Another cutout portion 204*c* is formed in the agitating element at a position point symmetrical, with respect to the center of rotary axis 204*a*, to the position of the aforementioned cutout. That is, a pair of cutout portions 204*c* are formed at positions point symmetrical to each other with respect to the center of rotary axis 204*a*. Thus, this configuration of agitating element 204*b*3 makes it possible to prevent output ripples from occurring at toner concentration sensor 213 due to developer's volume density change which would occur as agitating element 204*b* of mixing roller 204 rotates.

Arranged between developing roller 202 and mixing roller 204, as shown in FIG. 4 is paddle roller 203, which agitates and electrifies the developer that was prepared by mixing of mixing roller 204 to supply the developer to developing roller 202.

Paddle roller 203 is formed with a supporting shaft extending longitudinally and a plurality of flat plate-like blades radially extending from the supporting shaft so that the blades can rotate about the supporting shaft. As paddle roller 203 rotates about the supporting shaft, the developer can be agitated.

As described above, carrier collecting roller 220 for collecting the magnetic carrier having adhered to photoreceptor drum 3 is arranged below developing roller 202 so as to abut photoreceptor drum 3. Carrier removing device 230 which removes the magnetic carrier collected by this carrier collecting roller 220 therefrom is arranged at a position on the downstream side with respect to the rotational direction of carrier collecting roller 220.

Figure 7:
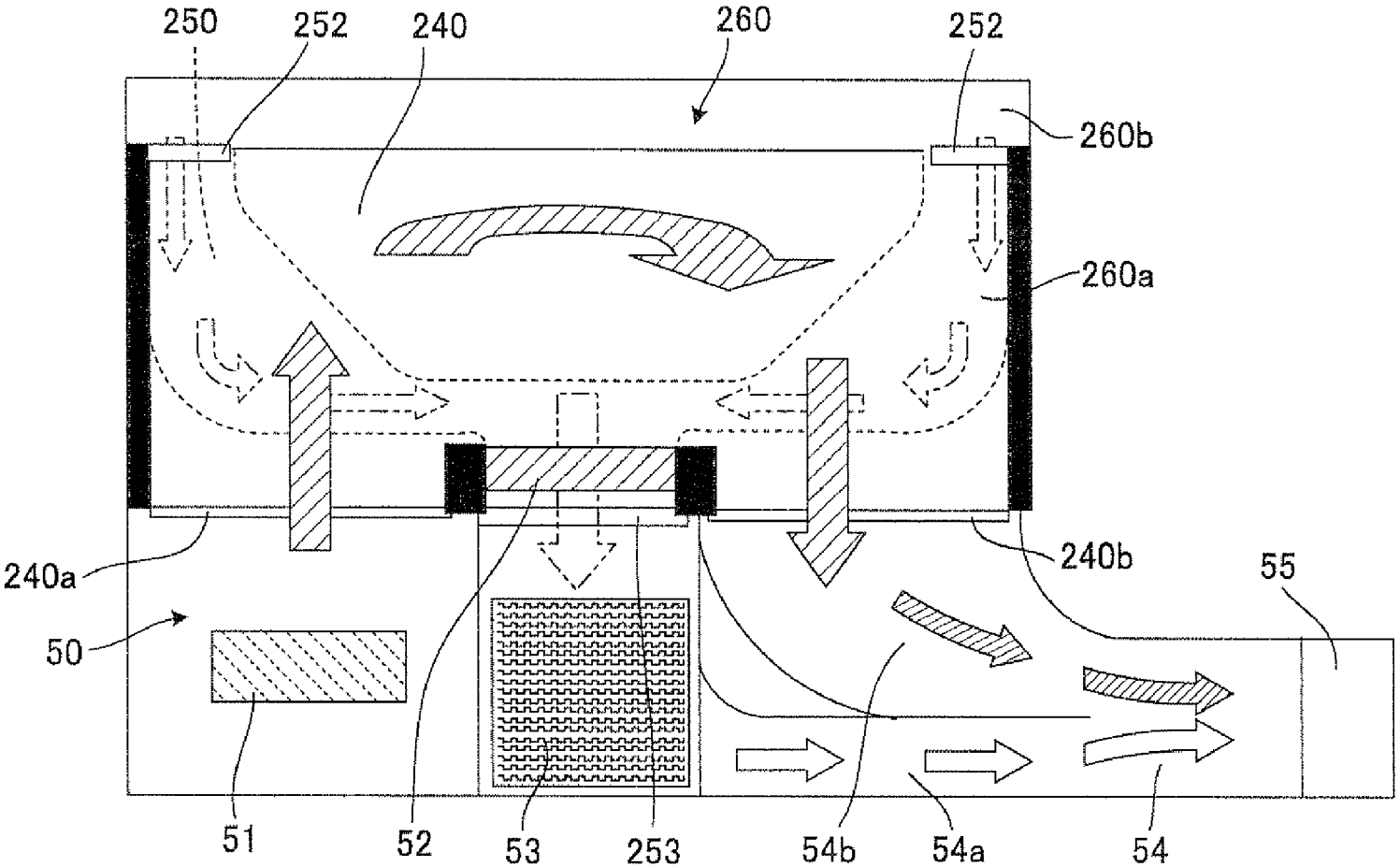
FIG. 7 is a plan view schematically showing a base structure of a developing unit of the same embodiment when viewed from top.

Next, the base structure 260 which is the characteristic part of developing unit 2 according to the present embodiment will be described in detail with reference to the drawings. FIG. 6 is a perspective view showing the configuration of an exterior wall 260*b* that defines a suctioning duct 250 in the base structure of the developing unit of this embodiment. FIG. 7 is a plan view schematically showing the base structure of the developing unit of the same embodiment when viewed from top.

Base structure 260 is integrally formed of a cooling portion that is formed on the bottom 200*b* (FIG. 4) side of developing vessel 200 and includes forced draft duct 240 (FIG. 4) for airflow sent from blowing fan 51 provided in duct unit 50, and a suctioning portion which is formed under forced draft duct 240 and includes suctioning duct 250 (FIG. 4) for airflow from suctioning ports through which scattering toner around the developing area of developing unit 2 is drawn in. Here, as mentioned already, the cooling portion and the suctioning portion may be formed separately in base structure 260.

In order to define forced draft duct 240 and suctioning duct 250, base structure 260 includes partitioning wall 260*a* and an exterior wall 260*b* as shown in FIG. 4.

Partitioning wall 260*a* is formed so as to cover substantially the whole area of bottom 200*b* while defining forced draft duct 240 between itself and bottom 200*b* when base structure 260 is mounted to bottom 200*b* of developing vessel 200.

Exterior wall 260*b* is formed so as to cover partitioning wall 260*a* while defining suctioning duct 250 between itself and partitioning wall 260*a*. Though exterior wall 260*b* of the present embodiment is constructed so as to cover partitioning wall 260*a* as a whole, the present technology should not be limited to this. That is, the exterior wall will achieve its expected function as long as it covers part of partitioning wall 260*a* that can form suctioning duct 250.

Partitioning wall 260*a* has a first side that opposes bottom 200*b* of developing vessel 200 and a second side that opposes exterior wall 260*b*.

This base structure 260 (FIG. 6) is connected to duct unit 50.

Duct unit 50 includes blowing fan 51 for blowing air for cooling developing vessel 200, a suctioning fan 53 as a suctioning source for drawing scattering toner and an exhaust duct 54 for leading air from forced draft duct 240 and suctioning duct 250 to an exhaust port 55.

Blowing fan 51 blows air into forced draft duct 240. Suctioning fan 53 draws air from suctioning duct 250.

Forced draft duct 240 has, as shown in FIG. 7, a forced draft entrance 240*a* as an inlet of air from blowing fan 51 and a forced draft exit 240*b* as an outlet.

Forced draft entrance 240*a* and forced draft exit 240*b* are formed at both ends (they may be formed near both ends at each end side with) respect to the longitudinal direction (axial direction) of developing roller 202 with a predetermined distance (the width of a combined suctioning port 253 in this embodiment) apart from each other. However, its layout should not be limited to this.

Forced draft duct 240 is formed in a bracket shape ([) or U-shape from forced draft entrance 240*a* toward forced draft exit 240*b*, but its layout should not be limited to this.

The opening at forced draft entrance 240*a* and the opening at forced draft exit 240*b* are oriented in the same direction, but their layout should not be limited to this. The two openings may be oriented in different directions.

In sum, forced draft duct 240 may take any configuration as long as it can cool bottom 200*b*.

In the present embodiment, in order to be able to cool entire part of bottom 200*b* of developing unit 2, forced draft duct 240 is constructed so as to cover substantially whole surface of bottom 200*b* of developing vessel 200 as shown in FIG. 7. However, its layout should not be limited to this.

Air passing through forced draft duct 240 is sent out from forced draft exit 240*b*, then discharged from exhaust port 55, passing through a forced draft exhaust duct 54*b* and common exhaust duct 54.

On the other hand, suctioning duct 250 has two suctioning ports 252 for suctioning scattering toner on the upstream side with respect to the direction of airflow and one combined suctioning port 253 on the downstream side, forming an approximately Y-shaped passage. However, the shape of suctioning duct 250 is not limited to this approximate Y-shape.

The two suctioning ports 252 as the entrance for scattering toner are arranged near both ends of carrier collecting roller 200 where toner scattering is prone to occur, for example, at both lower ends of the carrier collecting roller only. Accordingly, it is possible to reduce the suctioning load on suctioning fan 53 and realize efficient suction.

The ratio between the open width of suctioning port 252 and the length of the non-opening portion between two suctioning ports 252 and 252 with regard to the longitudinal direction (axial direction) of carrier collecting roller 220 can be experimentally determined so as to maximize the above operational effect.

Though the openings of suctioning ports 252 are oriented toward photoreceptor drum 3, their layout should not be limited to this. That is, the openings may be oriented toward, for example carrier collecting roller 220, toward the opposing portion between photoreceptor drum 3 and carrier collecting roller 220 or the like, so that scattering toner can be efficiently collected.

Air streams containing scattering toner that have been suctioned from two suctioning ports 252 provided at both ends of carrier collecting roller 220 are converged so that the combined airflow passes through a filter 52 for removing the scattering toner from the air that contains scattering toner and is suctioned from combined suctioning port 253 by suctioning fan 53.

Combined suctioning port 253 is formed between forced draft entrance 240*a* and forced draft exit 240*b* with respect to the longitudinal direction (axial direction) of developing roller 202 and the opening of combined suctioning port 253 is oriented in the same direction as that of forced draft entrance 240*a* and forced draft exit 240*b*. However, its layout should not be limited to this.

Air having passed through the filter 52 and combined suctioning port 253 is discharged from exhaust port 55 through suctioning exhaust duct 54*a* and common exhaust duct 54.

In the above way, formation of suctioning duct 250 that includes a pair of suctioning ports 252 arranged at both ends and on the lower side of carrier collecting roller 220 and one combined suctioning port 253 formed on the upstream of suctioning fan 53, makes it possible to achieve smooth suction of scattering toner without causing any buildup of toner etc. inside suctioning duct 250.

In order to facilitate maintenance, filter 52 is adapted to be able to be inserted into and removed from a filter holder 52*a* (FIG. 6) from above, which is formed at a position close to suctioning fan 53 in base structure 260. Further, in the present embodiment, in order to achieve more efficient suctioning, cooling and exhausting by smoothing air flow in each duct, all the corners in suctioning duct 250, cooling duct 240 and exhaust duct 54 at which the direction of airflow turns are formed with curved surfaces (round surfaces) as shown in FIG. 7.

As has been described, in the present embodiment, scattering toner around the developing area where photoreceptor drum 3 and developing roller 202 abut each other is suctioned from the lower side of carrier collecting roller 220, so that it is possible to collect the scattering toner that is sufficiently separated from the carrier. Accordingly, it is possible to prevent filter clogging and carrier reduction, which would occur when the toner together with carrier particles is suctioned. Further, since the airflow from blowing fan 51 is applied through forced draft duct 240 onto approximately the whole surface of bottom 200*b* of developing vessel 200, this arrangement brings about a remarkable cooling effect on developing vessel 200 of developing unit 2.

Though in the above first embodiment, forced draft duct 240 and suctioning duct 250 are constructed with two layered separate channels so as to be connected to blowing fan 51 and suctioning fan 53, respectively, forced draft duct 240 and suctioning duct 250 may be joined to be a single air passage in which only a single fan is arranged at a site therein. This configuration enables use of a single fan in common for both cooling and suction by arranging it at the exhaust port, for example.

(Aging Test)

Figure 9:
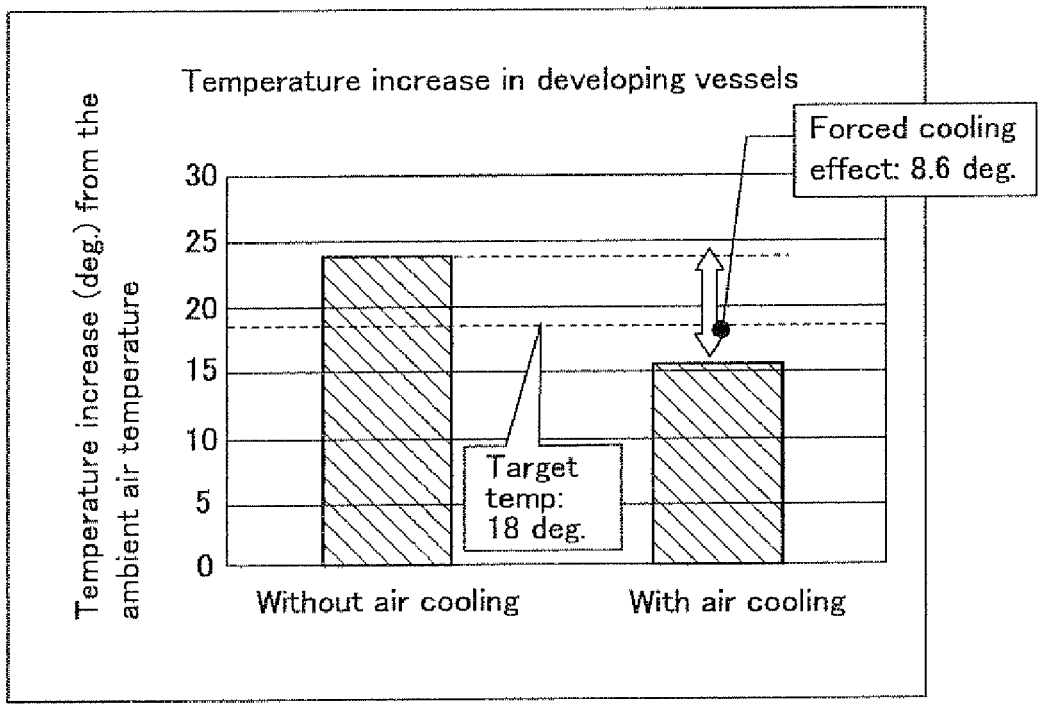
FIG. 9 is a graph showing temperature increase of developing vessels in aging tests, making a comparison between when air cooling is performed, and when not performed, by a cooling portion; and, FIG. 10 is a table showing comparative results between a developing unit incorporating the disclosed technology and a conventional developing unit.

Next, the effect obtained from the developing unit configuration will be explained by comparing the developing unit of the first embodiment with a conventional developing unit. FIG. 8 is a table showing various setting conditions in aging tests. FIG. 9 is a graph showing temperature increase of developing vessels in the aging tests, making a comparison between when air cooling is performed, and when not performed, by a cooling portion of the first embodiment, specifically showing the increase in temperature from the ambient temperature in relation to whether the cooling is performed or not. FIG. 10 is a table showing comparative results of the aging test between the developing unit of the first embodiment and a conventional developing unit. This table shows the amounts of carrier reduction after an aging run of 500 K ($500\times10^3$) printouts, the amounts of filter's weight increase (the sum of weight increase; each filter was replaced every 100 K ($100\times10^3$) printouts) and the number of times the operation failures occurred due to solidification of the developer during the 500 K aging run. Here, the conventional developing unit has no cooling mechanism as the cooling portion provided for the developing unit in the first embodiment and no carrier collecting roller. Also, the conventional developing unit is configured so as to perform suctioning from the lower part at both ends of the developing roller, in the same manner as in the developing unit according to the first embodiment.

In the aging test, developing unit 2 was designed so as to meet the conditions as shown in FIG. 8 and was operated. As described above, the developing unit 2 according to the first embodiment is constructed such that forced draft duct 240 functioning as a cooling portion is arranged at the top of suctioning duct 250 functioning as suctioning portion so as to blow air across the whole part of bottom 200*b* of developing vessel 200. As a result, as shown in FIG. 9, with no air cooling performed by the cooling portion, the temperature increase from the ambient air temperature was 24.1 deg. In contrast, when the cooling portion was used, the temperature increase from the ambient air temperature was 15.5 deg. That is, as the forced cooling effect of the cooling portion including suctioning duct 250 and blowing fan 51 of the present technology, a temperature reduction of 8.6 deg. (=24.1 deg.−15.5 deg.) was achieved. That is, the temperature increase from the ambient air temperature can be reduced to equal to or lower than 18 degree, which is the target value of the temperature increase, with which preferable result can be obtained without causing any operation failure and other problems with regards to the developing unit. Thus, it is possible to prevent developing unit 2 from failing to operate from solidification of the developer inside the developing unit as a result of temperature increase of developing unit 2 due to high-speed operations.

Further, in developing unit 2 suctioning ports 252 as the entrance of suctioning duct 250 are formed at both ends on the lower side of carrier collecting roller 220. The air streams containing scattering toner suctioned from these suctioning ports 252 pass through suctioning duct 25 and are collected into combined suctioning port 253 with filter 52 that is arranged at the center on the opposite side of developing vessel 200 from its side with developing roller 202. The thus filtrated airflow is further drawn toward exhaust port 55 by way of suctioning fan 53, suctioning exhaust duct 54*a* and common exhaust duct 54. As a result, in the developing unit, it is possible to collect the scattering toner that is sufficiently separated from the carrier by performing suction from the lower side of carrier collecting roller 220, hence it is possible to suppress clogging in the filter etc. and reduction of the carrier, compared to the conventional developing unit, as shown in FIG. 10.

Further, since suction is performed positively and selectively from both ends of carrier collecting roller 200, at which toner scattering is most prone to occur, it is possible to realize suctioning without causing any increase in waste suctioning load. Further, since suctioning duct 250 is formed so as to suction air from both ends towards the center to thereby realize smooth suction, no buildup of toner etc., will occur inside suctioning duct 250. Accordingly, it is possible to reduce the number of operation failures of developing unit 2 occurring due to solidified developer or the like inside the developing unit, as shown in FIG. 10.

That is, since, in developing unit 2, toner can be suctioned by sufficiently separating the carrier from the toner, it is possible to collect toner without capturing carrier in filter 52, reduce the filter's weight increase, or more explicitly inhibit reduction of the amount of carrier in the developer. Further, since cooling of developing vessel 200 in developing unit 2 is performed by cooling bottom 200*b* of developing unit 2 as a whole by providing a cooling passage that is separate from the suctioning passage, operation failures hardly occur.

Having described the preferred embodiment with reference to the attached drawings, it goes without saying that the present technology should not be limited to the above-described examples, and it is obvious that various changes and modifications will occur to those skilled in the art within the scope of the appended claims. Such variations are therefore understood to be within the technical scope of the present technology.

For example, though, in the above-described first embodiment, the present technology is applied to a developing unit that is mounted to a monochrome image forming apparatus including a single toner container, it is also possible to apply the cooling mechanism of the developing vessel and the suctioning mechanism of scattering toner using the ducts of the developing unit, to a developing unit for color printing including a plurality of toner containers.

The invention claimed is:

1. A developing unit for developing an electrostatic latent image formed on the outer peripheral surface of a latent image bearing member rotating in one direction with an electrified developer that is prepared by mixing two components, or an electrostatically chargeable toner and magnetic carrier in a developing vessel, comprising:

a developing roller for conveying the developer to the latent image bearing member;

a carrier collecting roller disposed on the downstream side of the developing roller with respect to the rotational direction of the latent image bearing member;

a cooling portion including a forced draft duct for airflow from a cooling fan and disposed on the bottom side of the developing vessel;

a suctioning portion including a suctioning duct for conducting an airflow from suctioning ports disposed on the lower side of the carrier collecting roller for collecting scattered toner, the suctioning duct being disposed under the forced draft duct;

a filter disposed in the suctioning portion for removing the scattered toner from the airflow in the suctioning duct; and, an exhaust portion including an airflow exhaust duct that receives and combines the airflow from the suctioning duct after it has passed through the filter and the airflow from the cooling portion after it has passed through the forced draft duct, the exhausting portion conducting the combined airflows to an exhaust port.

2. The developing unit according to claim 1, wherein in the cooling portion, a forced draft entrance as an inlet of the forced draft duct is arranged on one end side with respect to the axial direction of the developing roller and a forced draft exit as an outlet of the forced draft duct is arranged on the other end side, and the forced draft duct is formed so as to cover substantially the whole surface of the bottom of the developing vessel.

3. The developing unit according to claim 1, wherein the suctioning ports are arranged on the lower side at both ends of the carrier collecting roller.

4. The developing unit according to claim 1, wherein the suctioning duct includes first and second branches that conduct airstreams from first and second suctioning ports, respectively, located at opposite ends of the carrier collecting roller, wherein the first and second branches converge to a single main suction duct located before the filter, and wherein the filter has a structure that can be inserted into and removed from the suctioning portion.

5. The developing unit according to claim 1, further comprising a suction fan that is arranged between the filter and the airflow exhaust duct.

6. The developing unit according to claim 1, wherein the turning parts of the suctioning duct, the cooling duct and the exhaust duct are formed with rounded corners.

7. The developing unit according to claim 1, wherein the bottom of the developing vessel is formed of aluminum.

8. The developing unit according to claim 1, wherein a pressure adjustment filter for adjusting the pressure inside the developing vessel is provided in the developing vessel.

9. An image forming apparatus comprising a developing unit according to claim 1.

10. A developing unit for developing an electrostatic latent image on the outer peripheral surface of a latent image bearing member, comprising:

a developing roller located at a front of the developing unit, the developing roller conveying developer to the latent image bearing member;

a carrier collecting roller located at the front of the developing unit at a downstream side of the developing roller with respect to a rotational direction of the latent image bearing member;

a cooling duct located on a bottom of the developing unit, the cooling duct conducting a cooling airflow that cools the developing unit, wherein the cooling airflow exits the cooling duct at a rear of the developing unit; and a suction duct located under the cooling duct, the suction duct conducting a suction airflow from a lower side of the carrier collecting roller, the suction airflow collecting scattered toner, wherein the suction airflow exits the suction duct at a rear of the developing unit.

11. The developing unit of claim 10, wherein the suction duct conducts first and second suction airflows away from first and second suction ducts located at opposite ends of the carrier collecting roller.

12. The developing unit of claim 10, further comprising an exhaust duct located at a rear of the developing unit, wherein the cooling airflow from the cooling duct and the suction airflow from the suction duct join together in the exhaust duct, and wherein the exhaust duct conducts the combined airflows to an exhaust port.

13. The developing unit of claim 12, further comprising a suction fan located between the suction duct and the exhaust duct.

14. The developing unit of claim 13, further comprising a removably mounted filter disposed in the suction duct upstream from the suction fan.

15. The developing unit of claim 13, wherein the suction duct comprises first and second branches that lead from first and second suction ports located at opposite ends of the carrier collecting roller, and wherein the first and second branches come together to form a main suction branch that leads to the suction fan.

16. The developing unit of claim 13, further comprising a cooling fan located at a side of the rear of the developing unit, wherein the cooling fan blows air into the cooling duct.

17. The developing unit of claim 16, wherein the cooling duct conveys the cooling airflow from a first side of a rear of the developing unit to a central front portion of the developing unit, and then to a second side of the rear of the developing unit.

18. The developing unit of claim 17, wherein the exhaust port is located on a side of the rear of the developing unit, and wherein the exhaust duct comprises curved airflow guides that convey the combined airflows toward the exhaust port.

19. The developing unit of claim 12, wherein the exhaust port is located on a side of a rear of the developing unit, and wherein the exhaust duct comprises curved airflow guides that convey the combined airflows toward the exhaust port.

20. An image forming apparatus comprising a developing unit according to claim 10.

* * * * *